US006946429B2

(12) United States Patent
Akiyama

(10) Patent No.: US 6,946,429 B2
(45) **Date of Patent: *Sep. 20, 2005**

(54) BEARING FOR ELECTRONICALLY CONTROLLED THROTTLE MOTOR

(75) Inventor: Motoharu Akiyama, Miyota-Machi (JP)

(73) Assignee: Minebea Co., Ltd., Nagano (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/408,467

(22) Filed: Apr. 7, 2003

(65) Prior Publication Data

US 2003/0195125 A1 Oct. 16, 2003

(30) Foreign Application Priority Data

Apr. 8, 2002 (JP) ..... 2002-105018

(51) Int. Cl.[7] ..... C10M 169/02

(52) U.S. Cl. ..... 508/182; 508/154; 508/272; 508/281; 508/390; 508/582

(58) Field of Search ..... 508/182, 154, 508/272, 281, 582

(56) References Cited

U.S. PATENT DOCUMENTS

| | | | | |
|---|---|---|---|---|
| 4,324,673 A | | 4/1982 | Christian | |
| 4,472,290 A | * | 9/1984 | Caporiccio et al. | 508/181 |
| 4,724,002 A | * | 2/1988 | Shibata et al. | 106/31.61 |
| 4,985,161 A | * | 1/1991 | Tohzuka et al. | 508/182 |
| 5,518,639 A | * | 5/1996 | Luk et al. | 508/116 |
| 6,025,307 A | * | 2/2000 | Chittofrati et al. | 508/182 |
| 6,329,326 B1 | | 12/2001 | Iso et al. | |

FOREIGN PATENT DOCUMENTS

| | | |
|---|---|---|
| EP | 0856570 | 8/1998 |
| EP | 0 856 570 A | 8/1998 |
| JP | 1132690 | 5/1989 |
| JP | 01 132690 | 8/1989 |
| JP | 2000273478 | 10/2000 |
| JP | 2000 273478 A | 2/2001 |

OTHER PUBLICATIONS

Tonelli, et al. "Linear perfluoropolyether difunctional oligomers: chemistry properties and applications" Journal of Fluorine Chemistry, Elsevier Sequoia, Lausanne, CH vol. 95, No. 1–2 Jun. 9, 1999 pp. 51–70.

* cited by examiner

*Primary Examiner*—Ellen M. McAvoy
(74) *Attorney, Agent, or Firm*—James A. Quinton

(57) ABSTRACT

A bearing for an electronically controlled throttle motor in an automobile filled with a grease composition with a kinetic viscosity between 40 and 150 $mm^2$/sec (at 40° C.) containing (a) a straight-chain perfluoropolyether oil with a kinetic viscosity less than 25 $mm^2$/sec (at 40° C.) expressed by the formula $RfO(CF_2O)_p(C_2F_4O)_q(C_3F_6O)_rRf$ (where Rf is a perfluoro lower alkyl group, and p, q and r are integers whose total is between 25 and 45), (b) a base oil containing a straight-chain perfluoropolyether oil with a kinetic viscosity greater than 250 $mm^2$/sec (at 40° C.) expressed by the formula $RfO(CF_2O)_p(C_2F_4O)_q(C_3F_6O)_rRf$ (where Rf is a perfluoro lower alkyl group, and p, q and r are integers whose total is between 80 and 200) and (c) a polytetrafluoroethylene filler.

26 Claims, No Drawings

BEARING FOR ELECTRONICALLY CONTROLLED THROTTLE MOTOR

FIELD OF THE INVENTION

The present invention relates to a grease for a throttle motor bearing used in an electronically controlled throttle valve control device in an electronic throttle valve system without a wire between the accelerator pedal of the vehicle. The throttle valve has an accelerator opening sensor for detecting the degree to which the accelerator is open corresponding to the degree to which the accelerator pedal has been pressed down. A throttle motor opens and closes the throttle valve in response to the detection value of the accelerator opening sensor.

BACKGROUND OF THE INVENTION

Throttle motor bearings require greases that can withstand extreme operating conditions. An automobile grease having stable properties at temperatures ranging between −40° C. and 180° C. is desired. These temperatures are at the extreme limit of what is experienced in the coldest regions and the hottest desert regions where the throttle motor will likely be used. A bearing grease composition used in an electronically controlled throttle motor for an automobile must be low torque (especially rotational torque at low temperatures), have excellent noise properties, exhibit little leakage (or evaporation), have longevity, and operational capability at low temperatures and high temperatures (between −40° C. and 180° C.).

Fluorine-based greases have been used in bearings to satisfy these stringent requirements. Fluorine greases of the prior art contain perfluoropolyether base oils, tetrafluoroethylene copolymer fillers and trace amounts of antirust agents and corrosion inhibiting agents. In situations demanding low temperature properties, a straight-chain perfluoropolyether with excellent low temperature properties has been used. However, these fluorine greases cannot satisfy the more demanding high-load/low-torque properties and durability requirements of recent years. In order to meet these far more stringent requirements, a grease composition has been proposed (Japanese Unexamined Patent Disclosure [Kokai] No. 7-102274) which contains a liquid fluorinated polymer and a filler containing hexagonal lattice boron nitride powder with a diphasic granularity distribution. While this grease composition has excellent heat-resistance and durability, it does not exhibit low temperature torque properties. There is still a need in the art for improved bearing greases for throttle motors.

SUMMARY OF THE INVENTION

According to the invention, a grease for throttle motor bearings is provided which has high load/low torque properties through a wide range of temperatures encountered by automobiles. The present invention provides a bearing grease for an electronically controlled throttle motor with low torque under high-load conditions at low temperatures that is superior to grease compositions containing perfluoropolyether oil of the prior art.

The grease composition according to the invention, has a kinetic viscosity between 40 and 150 $mm^2$/sec (at 40° C.) and contains(a) a straight-chain perfluoropolyether oil with a kinetic viscosity less than 25 $mm^2$/sec (at 40° C.) expressed by the formula $RfO(CF_2O)_p(C_2F_4O)_q(C_3F_6O)_rRf$ (where Rf is a perfluoro lower alkyl group, and p, q and r are integers whose total is between 25 and 45), (b) a base oil containing a straight-chain perfluoropolyether oil with a kinetic viscosity greater than 250 $mm^2$/sec (at 40° C.) expressed by the formula $RfO(CF_2O)_p(C_2F_4O)_q(C_3F_6O)_rRf$ (where Rf is a perfluoro lower alkyl group, and p, q and r are integers whose total is between 80 and 200 preferably between 100 and 200) and (c) a polytetrafluoroethylene filler. As a result, a grease composition with high-load/low-torque properties between −40° C. and 40° C., preferably between −40° C. and 180° C. is provided.

In another aspect of the invention, a bearing for throttle motors is filled with a grease composed of a combination of a high and a low molecular weight perfluoropolyether oil composed of straight-chain polymers without any branched polymers mixed with a tetrafluoroethylene powder filler to complete a grease composition. The present invention provides a grease filled bearing for an electronically controlled throttle motor with low torque under high-load conditions at low temperatures.

Desirably the bearing for an electronically controlled throttle motor in an automobile is filled with a grease composition with a kinetic viscosity between 40 and 150 $mm^2$/sec (at 40° C.) containing (a) a straight-chain perfluoropolyether oil with a kinetic viscosity less than 25 $mm^2$/sec (at 40° C.) expressed by the formula $RfO(CF_2O)_p(C_2F_4O)_q(C_3F_6O)_rRf$ (where Rf is a perfluoro lower alkyl group, and p, q and r are integers whose total is between 25 and 45), (b) a base oil containing a straight-chain perfluoropolyether oil with a kinetic viscosity greater than 250 $mm^2$/sec (at 40° C.) expressed by the formula $RfO(CF_2O)_p(C_2F_4O)_q(C_3F_6O)_rRf$ (where Rf is a perfluoro lower alkyl group, and p, q and r are integers whose total is between 80 and 200, preferably between 100 and 200) and (c) a polytetrafluoroethylene filler. As a result a bearing for an electronically controlled throttle motor filled with a grease composition with high-load/low-torque properties between −40° C. and 40° C., preferably between −40° C. and 180° C. is provided.

It is an object of the invention to provide a bearing filled with a grease composition for an electronically controlled throttle motor for an automobile that is low torque.

It is an object of the invention to provide a bearing filled with a grease composition for an electronically controlled throttle motor for an automobile that exhibits low rotational torque at low temperature.

It is an object of the invention to provide a bearing filled with a grease composition for an electronically controlled throttle motor for an automobile that exhibits little leakage (or evaporation) at temperatures 40° C. and higher.

It is an object of the invention to provide a bearing filled with a grease composition for an electronically controlled throttle motor for an automobile that exhibits little leakage (or evaporation) at temperatures up to about 180° C.

It is an object of the invention to provide a bearing filled with a grease composition for an electronically controlled throttle motor for an automobile that can be used at temperatures between −40° C. and 180° C.

It is an object of the invention to provide a bearing filled with a grease composition for an electronically controlled throttle motor for an automobile has longevity, and operational capability at low temperatures and high temperatures (between −40° C. and 180°).

It is an object of the invention to provide a bearing filled with a grease composition for an electronically controlled throttle motor for an automobile that contributes to the quiet operation of the throttle motor.

It is an object of the invention to provide a grease composition for an electronically controlled throttle motor for an automobile that exhibits low rotational torque at low temperature.

It is an object of the invention to provide a grease composition for an electronically controlled throttle motor for an automobile that exhibits little leakage (or evaporation) at temperatures 40° C. and higher.

It is an object of the invention to provide a grease composition for an electronically controlled throttle motor for an automobile that exhibits little leakage (or evaporation) at temperatures up to about 180° C.

It is an object of the invention to provide a grease composition for an electronically controlled throttle motor for an automobile that can be used at temperatures between −40° C. and 180° C.

Other and further objects will become apparent from the appended specification drawing and claims. It should be understood that there are numerous embodiments contemplated by the subject invention. Every embodiment of the invention does not necessarily achieve every object of the invention.

The preferred embodiment of the present invention is illustrated in the drawings and examples. However, it should be expressly understood that the present invention should not be limited solely to the illustrative embodiment.

DETAILED DESCRIPTION OF THE INVENTION

According to the invention, a grease for throttle motor bearings is provided which has high load/low torque properties through a wide range of temperatures encountered by automobiles. The grease according to the invention can withstand extreme operating conditions and exhibits stable properties at temperatures ranging between −40° C. and 180° C. These temperatures are at the extreme limit of what is experienced in the coldest regions and the hottest desert regions where the throttle motor will likely be used. The grease when used in an electronically controlled throttle motor exhibits low torque (especially rotational torque at low temperatures), has excellent noise properties, exhibits little leakage (or evaporation), has longevity, and operational capability at low temperatures and high temperatures (between −40° C. and 40° C. preferably between −40° C. and 180° C.). The present invention provides a bearing grease for an electronically controlled throttle motor with low torque under high-load conditions at low temperatures which is superior to grease compositions containing perfluoropolyether oil of the prior art.

The grease according to the invention, contains(a) a straight-chain perfluoropolyether oil with a kinetic viscosity less than 25 $mm^2$/sec (at 40° C.) expressed by the formula $RfO(CF_2O)_p(C_2F_4O)_q(C_3F_6O)_rRf$ (where Rf is a perfluoro lower alkyl group, and p, q and r are integers whose total is between 25 and 45), (b) a base oil containing a straight-chain perfluoropolyether oil with a kinetic viscosity greater than 250 $mm^2$/sec (at 40° C.) expressed by the formula $RfO(CF_2O)_p(C_2F_4O)_q(C_3F_6O)_rRf$ (where Rf is a perfluoro lower alkyl group, and p, q and r are integers whose total is between 80 and 200 preferably between 100 and 200) and (c) a polytetrafluoroethylene filler. As a result, a grease composition with high-load/low-torque properties between −40° C. and 180° C. is provided.

In another aspect of the invention, a bearing for an electronically controlled throttle motor in an automobile is filled with a grease composed of a high and a low molecular weight perfluoropolyether oil composed of straight-chain polymers without any branched polymers mixed with a tetrafluoroethylene powder filler. The bearings in electronically controlled throttle motors generally have an outer diameter between 12 mm and 22 mm and an inner diameter between 4 mm and 8 mm. Desirably the bearing for an electronically controlled throttle motor in an automobile is filled with a grease composition with a kinetic viscosity between 40 and 150 $mm^2$/sec (at 40° C.) containing (a) a straight-chain perfluoropolyether oil with a kinetic viscosity less than 25 $mm^2$/sec (at 40° C.) expressed by the formula $RfO(CF_2O)_p(C_2F_4O)_q(C_3F_6O)_rRf$ (where Rf is a perfluoro lower alkyl group, and p, q and r are integers whose total is between 25 and 45), (b) a base oil containing a straight-chain perfluoropolyether oil with a kinetic viscosity greater than 250 $mm^2$/sec (at 40° C.) expressed by the formula $RfO(CF_2O)_p(C_2F_4O)_q(C_3F_6O)_rRf$ (where Rf is a perfluoro lower alkyl group, and p, q and r are integers whose total is between 80 and 200 preferably between 100 and 200) and (c) a polytetrafluoroethylene filler. As a result a bearing for an electronically controlled throttle motor filled with a grease composition with high-load/low-torque properties between −40° C. and 180° C. is provided.

Optionally either component a or b can be straight-chain perfluoropolyether oil with a molecular structure in which r=0. In such cases, because straight-chain perfluoropolyether oils with the chemical formula $(C_3F_6O)r$ have a lower viscosity index than straight-chain perfluoropolyether oils lacking the chemical formula $(C_3F_6O)r$, the viscosity rises at low temperatures and the torque is increased. Therefore, straight-chain perfluoropolyether oils with a molecular structure in which r=0 can also reduce the amount of torque at low temperatures. The following is a concrete example.

$$RfO(CF_2CF_2O)_m(CF_2O)_nRf$$

$$m+n=3\sim200$$

$$m:n=10:90 \text{ to } 90:10$$

These polymers are obtained by completely fluorinating a precursor obtained by photooxidizing and polymerizing tetrafluoroethylene.

The components of the grease of the present invention (a) and (b) when used alone do not provide a satisfactory composition for a bearing grease for use in a throttle motor. Perfluoropolyether oil with a low molecular weight and a kinetic viscosity (at 40° C.) under 25 $mm^2$, preferably between 5 and 25 $mm^2$ (JIS K-2283; −40° C.) generates excessive heat which can adversely affects the heat-resistance of the electronically controlled throttle motor bearing. Perfluoropolyether oil with a high molecular weight and a kinetic viscosity (at 40° C.) higher than 250 $mm^2$, preferably between 250 and 500 $mm^2$ (JIS K-2283; −40° C.),has a high fluidity point h (JIS K-2283), the torque is then higher in the electronically controlled throttle motor bearing at low temperatures under normal use.

A bearing containing perfluoropolyether oils with different viscosities has different properties. Perfluoropolyether oil (a) has a higher viscosity index, low temperature torque capability and low friction properties but makes the bearing less heat-resistance. A bearing containing perfluoropolyether oil (b) has poorer low temperature torque capability, but lower volatility and higher oil film retention at high temperatures. By filling a bearing with grease containing a mixture of straight-chain perfluoropolyether oils with different viscosities, low temperature torque capabilities are maintained while providing more durability. Thus, by mixing perfluoropolyether oil (a) with perfluoropolyether oil (b) properly, the low temperature torque capability of perfluoropolyether oil (a) is retained while providing greater heat-resistance and durability. Preferably the ratio of perfluoropolyether oil (a) to perfluoropolyether oil (b) in the grease added to the electronically controlled throttle motor bearing should be perfluoropolyether oil (a):perfluoropolyether oil (b)=90:10 to 10:90 in order to obtain the advantages of both.

A bearing containing a base oil consisting merely of a straight-chain perfluoropolyether oil with a molecular weight between low molecular weight perfluoropolyether oil (a) and high molecular weight perfluoropolyether oil (b), contrary to expectation, causes the bearing to have high torque. However, when a straight-chain perfluoropolyether oil with a molecular weight between (a) and (b) composes less than 20 mass % of the base oil, the purpose the present invention, which is high-load/low-torque at low temperatures, can be achieved.

The polytetrafluoroethylene (c) used as the filler in the grease added to the electronically controlled throttle motor bearing is obtained by copolymerizing tetrafluoroethylene in the presence of a molecular weight regulating agent. A telomer is obtained with a melting point between 310 and 330° C. The polymerization method can be solution polymerization, emulsion polymerization or suspension polymerization, and the resulting high molecular weight polytetrafluoroethylene can be reduced to an average molecular weight between 1000 and 500,000 using thermal decomposition, gamma ray irradiation or mechanical pulverization. The polytetrafluoroethylene obtained in this manner desirably had an average primary grain diameter of 500 $\mu$m or less, and a preferred average primary grain diameter between 0.05 and 20 $\mu$m.

Preferably, the polytetrafluoroethylene filler consists of a mixture of grains with a low average diameter and grains with a high average diameter. Desirably, filler component (c) consists of 5~95 mass % grains with an average diameter of less than 0.5 $\mu$m and 95~5 mass % grains with an average diameter greater than 5 $\mu$m. Desirably, polytetrafluoroethylene filler with an average diameter less than 0.5 $\mu$m is emulsion polymerized polytetrafluoroethylene (molecular weight 100,000~200,000, primary grain diameter 0.2 $\mu$m) or solution polymerized polytetrafluoroethylene (molecular weight 100,000~200,000, primary grain diameter 0.1 $\mu$m). Desirably the polytetrafluoroethylene filler with an average grain diameter greater than 5 $\mu$m composes between 1 and 60 mass % and preferably between 5 and 30 mass % of the grease composition.

The grease composition added to the electronically controlled throttle motor bearing of the present invention can include, if desired, an antirust agent or corrosion inhibiting agent well known in the art. Antirust agents include fatty acids, fatty acid soaps, fatty acid amines, alkyl sulfonic acid salts, oxidized paraffin, polyoxyalkylethers, sodium sulfonate, barium sulfonate, potassium sulfonate, calcium sulfonate, alkyl naphthalene, sodium nitrite and sodium nitrate. Corrosion inhibiting agents include benzotriazole, benzoimidazole and thiadiazole.

There are no restrictions on the method used to prepare the grease composition added to the electronically controlled throttle motor bearing of the present invention. For example, the two different perfluoropolyether oils, the polytetrafluoroethylene and the additives can be mixed together and kneaded thoroughly using three rollers or a high pressure homogenizer.

Desirably, the grease of the present invention fills 20 to 40 vol % of the bearing space in an electronically controlled throttle motor bearing for an automobile. Here, the bearing space extends from the sealed space surrounding the inner and outer rings to include the rotating member (pole) and the volume of the retainer.

The following are examples of the present invention. The present invention is by no means restricted to these working examples. The following perfluoropolyether oils were used as the base oils in the grease compositions added to the bearings in the electronically controlled throttle motors of the present invention.

(Base Oils)

Four different perfluoropolyethers expressed by the formula $RfO(CF_2CF_2O)_m(CF_2O)_nRf$ were prepared.

A-1: Kinetic viscosity (at 40° C.) of 15 $mm^2$/sec m+n=35

A-2: Kinetic viscosity (at 40° C.) of 70 $mm^2$/sec m+n=60

A-3: Kinetic viscosity (at 40° C.) of 85 $mm^2$/sec m+n=70

A-4: Kinetic viscosity (at 40° C.) of 320 $mm^2$/sec m+n=110

The grease used in the present invention used A-1 as component (a) and A-4 as component (b).

The following polytetrafluoroethylenes were used as the fillers in the grease compositions added to the bearings in the electronically controlled throttle motors of the present invention.

(Fillers)

B-1: Emulsion polymerized polytetrafluoroethylene (molecular weight 100,000~200,000, primary grain diameter 0.2 $\mu$m)

B-2: Solution polymerized polytetrafluoroethylene (molecular weight 100,000~200,000, primary grain diameter 0.1 $\mu$m)

B-3: Suspension polymerized polytetrafluoroethylene (molecular weight 50,000~100,000, primary grain diameter 13 $\mu$m)

In the grease composition of the present invention, B-1 and/or B-2 is used as component (d) and B-3 is used as component (e).

WORKING EXAMPLE 1

Two different perfluoropolyethers, A-1 for composition (a) and A-4 for composition (b) were mixed together at a mass ratio of 3:1 to prepare a base oil with a kinetic viscosity (at 40° C.) of 45 $mm^2$/sec. Polytetrafluoroethylene B-2 was added as filler to the composition until it composed 20 mass % of the total, and the composition was mixed and kneaded using three rollers to obtain a grease composition.

Grease compositions were prepared for Working Examples 2 through 12 and Comparative Examples 1 through 3 in the same manner as above. The compositional ratios are shown in Table 1.

TABLE 1

| | Base Oil | | | Filler | Filler Amt. |
|---|---|---|---|---|---|
| Example | Composition | | Viscosity (40° C.) | Composition | (wt %) |
| WE 1 | A-1 | A-4 | 45 | B-2 (100) | 20 |
| WE 2 | A-1 | A-4 | 55 | B-2 (100) | 20 |

TABLE 1-continued

| Example | Base Oil Composition | | Base Oil Viscosity (40° C.) | Filler Composition | | Filler Amt. (wt %) |
|---|---|---|---|---|---|---|
| WE 3 | A-1 | A-4 | 85 | B-2 (100) | | 20 |
| WE 4 | A-1 | A-4 | 85 | B-1 (20) | B-3 (80) | 30 |
| WE 5 | A-1 | A-4 | 85 | B-1 (40) | B-3 (60) | 35 |
| WE 6 | A-1 | A-4 | 100 | B-1 (100) | | 30 |
| WE 7 | A-1 | A-4 | 120 | B-1 (30) | B-3 (70) | 35 |
| WE 8 | A-1 | A-4 | 120 | B-2 (100) | | 20 |
| WE 9 | A-1 | A-4 | 140 | B-1 (100) | | 20 |
| WE 10 | A-1 | A-4 | 140 | B-1 (30) | B-3 (70) | 30 |
| WE 11 | A-1 | A-4 | 200 | B-2 (100) | | 20 |
| WE 12 | A-1 | A-4<br>A-2 (10) | 70 | B-1 (100) | | 20 |
| WE 13 | A-1 | A-4<br>A-3 (15) | 85 | B-2 (100) | | 20 |
| CE 1 | A-2 | | 70 | B-1 (100) | | 35 |
| CE 2 | A-3 | | 85 | B-2 (100) | | 25 |
| CE 3 | A-3 | | 85 | B-3 (100) | | 25 |

The grease compositions in the working examples and comparative examples were injected into the bearings of electronically controlled throttle motors for automobiles. The properties of the grease compositions were then tested in the following manner.

(1) Low-Temperature Torque Test-1

The grease was added to a deep groove ball bearing with a rubber seal (inner diameter ϕ8, outer diameter ϕ22, width 7 mm) until it took up 30% of the bearing volume. After rotating the bearing for 10 seconds at 1800 rpm, it was allowed to stand for two hours in a −40° C. tank pressurized to 20N. The torque was then measured when the inner shaft was rotated at 300 rpm. Maximum torque was achieved within 10 seconds of initial rotation, and the torque values were evaluated at the initial stage and after five minutes.

(2) Low-Temperature Torque Test-2

The grease was added to a deep groove ball bearing with a rubber seal (inner diameter ϕ8, outer diameter ϕ22, width 7 mm) until it took up 30% of the bearing volume. After rotating the bearing for 10 seconds at 1800 rpm, it was allowed to stand for two hours in a −40° C. tank pressurized to 300N. The torque was then measured when the inner shaft was rotated at 300 rpm. Maximum torque was achieved within 10 seconds of initial rotation, and the torque values were evaluated at the initial stage and after five minutes.

(3) Rotational Longevity Test: A Longevity Test was Performed under the Following Conditions until there was Burning.

Bearing: 608
Load: 3.9 kgf
Temperature: 180° C.
Rotational Speed: 3000 RPM

The results are shown in Table 2.

TABLE 2

| | Low Temp Torque Test-1 (g cm) | | Low Temp Torque Test-2 (g cm) | | Rotation Longevity |
|---|---|---|---|---|---|
| | Initial | After 5 Min. | Initial | After 5 Min. | Test |
| WE 1 | 270 | 90 | 700 | 325 | B |
| WE 2 | 300 | 100 | 770 | 320 | B |
| WE 3 | 380 | 110 | 800 | 320 | A |
| WE 4 | 350 | 80 | 830 | 240 | A |

TABLE 2-continued

| | Low Temp Torque Test-1 (g cm) | | Low Temp Torque Test-2 (g cm) | | Rotation Longevity |
|---|---|---|---|---|---|
| | Initial | After 5 Min. | Initial | After 5 Min. | Test |
| WE 5 | 360 | 70 | 850 | 260 | A |
| WE 6 | 400 | 120 | 860 | 500 | A |
| WE 7 | 410 | 80 | 870 | 255 | A |
| WE 8 | 410 | 130 | 900 | 460 | A |
| WE 9 | 420 | 140 | 950 | 350 | A |
| WE 10 | 450 | 90 | 960 | 260 | A |
| WE 11 | 490 | 180 | 990 | 600 | A |
| WE 12 | 520 | 310 | 950 | 750 | B |
| WE 13 | 560 | 310 | 990 | 200 | B |
| CE 1 | 670 | 300 | 1100 | 900 | B~C |
| CE 2 | 600 | 360 | 1100 | 180 | B |
| CE 3 | 750 | 200 | 1300 | 900 | B |

A: Excellent
B: Good
C: Fair
D: Poor

As shown in Table 2, the electronically controlled throttle motor bearings containing a grease composition consisting of a high molecular weight, high viscosity straight-chain perfluoropolyether and a low molecular weight, low viscosity straight-chain perfluoropolyether as the base oils and a polytetrafluoroethylene as the filler had high-load/low-torque properties at low temperatures. The result is an electronically controlled throttle motor bearing with high-load/low-torque durability at low temperatures that cannot be achieved using fluorine greases of the prior art.

The foregoing is considered as illustrative only to the principals of the invention. Further, since numerous changes and modification will occur to those skilled in the art, it is not desired to limit the invention to the exact construction and operation shown and described above, and accordingly, all suitable modifications and equivalents may be resorted to, falling within the scope of the invention.

What is claimed is:

1. A bearing for an electronically controlled throttle motor in an automobile comprising said bearing filled with a grease composition with a kinetic viscosity between 40 and 150

$mm^2$/sec at 40° C. containing (a) a straight-chain perfluoropolyether oil with a kinetic viscosity less than 25 $mm^2$/sec at 40° C. expressed by the formula $RfO(CF_2O)_p(C_2F_4O)_q(C_3F_6O)_rRf$ wherein Rf is a perfluoro lower alkyl group, and p, q and r are integers whose total is between 25 and 45), (b) a base oil containing a straight-chain perfluoropolyether oil with a kinetic viscosity greater than 250 $mm^2$/sec at 40° C. expressed by the formula $RfO(CF_2O)_p(C_2F_4O)_q(C_3F_6O)_rRf$ wherein Rf is a perfluoro lower alkyl group, and p, q and r are integers whose total is between 80 and 200 and (c) a polytetrafluoroethylene filler.

2. The bearing for an electronically controlled throttle motor in an automobile filled with a grease composition with a kinetic viscosity between 40 and 150 $mm^2$/sec at 40° C. according to claim 1, wherein said straight-chain perfluoropolyether oils in (a) r is 0 group, and p, q are integers and the total of p+q is between 25 and 45 and in (b) r is 0, and p+q is between 80 and 200.

3. The bearing for an electronically controlled throttle motor in an automobile filled with a grease composition with a kinetic viscosity between 40 and 150 $mm^2$/sec at 40° C. according to claim 1 or claim 2 wherein (c) said polytetrafluoroethylene filler comprises mixture of grains having a low average diameter and a high average diameter.

4. The bearing for an electronically controlled throttle motor in an automobile filled with a grease composition with a kinetic viscosity between 40 and 150 $mm^2$/sec at 40° C. according to claim 3 wherein (c) said polytetrafluoroethylene filler is composed of 5 to 95 wt % grains with diameters under 0.5 $\mu$m and 95 to 5 wt % grains with diameters over 5 $\mu$m.

5. The bearing for an electronically controlled throttle motor in an automobile filled with a grease composition with a kinetic viscosity between 40 and 150 $mm^2$/sec at 40° C. according to claim 3 wherein (c) the polytetrafluoroethylene filler having a grain diameter of less than 5 $\mu$m is 1 to 60% by weight of said grease composition.

6. The bearing for an electronically controlled throttle motor in an automobile filled with a grease composition with a kinetic viscosity between 40 and 150 $mm^2$/sec at 40° C. according to claim 3 wherein (c) the polytetrafluoroethylene filler having a grain diameter of less than 5 $\mu$m is 5 to 30% by weight of the grease composition.

7. The bearing for an electronically controlled throttle motor in an automobile filled with a grease composition with a kinetic viscosity between 40 and 150 $mm^2$/sec at 40° C. according to claim 1 or 2, further comprising a straight-chain perfluoropolyether oil with a kinetic viscosity between 40 and 150 $mm^2$/sec at 40° C. expressed by the formula $RfO(CF_2O)_p(C_2F_4O)_q(C_3F_6O)_rRf$ wherein Rf is a perfluoro lower alkyl group, and p, q and r are integers whose total is between 50 and 80 composes less than 20 mass % of the base oil.

8. The bearing for an electronically controlled throttle motor in an automobile filled with a grease composition with a kinetic viscosity between 40 and 150 $mm^2$/sec at 40° C. according to claim 1 or 2, further comprising an antirust agent, a corrosion inhibiting agent or both.

9. The bearing for an electronically controlled throttle motor in an automobile filled with a grease composition with a kinetic viscosity between 40 and 150 $mm^2$/sec at 40° C. according to claim 8 , wherein said antirust agent is fatty acids, fatty acid soaps, fatty acid amines, alkyl sulfonic acid salts, oxidized paraffin, polyoxyalkylethers, sodium sulfonate, barium sulfonate, potassium sulfonate, calcium sulfonate, alkyl naphthalene, sodium nitrite or sodium nitrate.

10. The bearing for an electronically controlled throttle motor in an automobile filled with a grease composition with a kinetic viscosity between 40 and 150 $mm^2$/sec at 40° C. as described in claim 8 wherein said corrosion inhibiting agent is benzotriazole, benzoimidazole or thiadiazole.

11. The bearing for an electronically controlled throttle motor in an automobile filled with a grease composition with a kinetic viscosity between 40 and 150 $mm^2$/sec at 40° C. according to claim 1 or 2 wherein the bearing is housed in a bearing space said grease composition filling 20 to 40% of said bearing space.

12. The bearing according to claim 1 wherein said bearing is operational at a temperature range of −40° C. to 180° C.

13. The bearing according to claim 1 or 2 wherein (b) the total of p,q and r is 100 to 200.

14. A grease composition with a kinetic viscosity between 40 and 150 $mm^2$/sec at 40° C. for an electronically controlled throttle motor in an automobile comprising (a) a straight-chain perfluoropolyether oil with a kinetic viscosity less than 25 $mm^2$/sec at 40° C. expressed by the formula $RfO(CF_2O)_p(C_2F_4O)_q(C_3F_6O)_rRf$ (where Rf is a perfluoro lower alkyl group, and p, q and r are integers whose total is between 25 and 45), (b) a base oil containing a straight-chain perfluoropolyether oil with a kinetic viscosity greater than 250 $mm^2$/sec at 40° C. expressed by the formula $RfO(CF_2O)_p(C_2F_4O)_q(C_3F_6O)_rRf$ wherein Rf is a perfluoro lower alkyl group, and p, q and r are integers whose total is between 80 and 200 and (c) a polytetrafluoroethylene filler.

15. A grease composition with a kinetic viscosity between 40 and 150 $mm^2$/sec at 40° C. as described in claim 14, wherein said straight-chain perfluoropolyether oils in (a) r is 0, p, q are integers and the total of p+q is between 25 and 45 and in (b) r is 0, and p+q is between 80 and 200.

16. A grease composition according to claim 14 or claim 15, wherein (c) said polytetrafluoroethylene filler comprises mixture of grains having a low average diameter and a high average diameter.

17. The grease composition with a kinetic viscosity between 40 and 150 $mm^2$/sec at 40° C. according to claim 16 wherein (c) said polytetrafluoroethylene filler is composed of 5 to 95 wt % grains with diameters under 0.5 $\mu$m and 95 to 5 wt % grains with diameters over 5 $\mu$m.

18. The grease composition with a kinetic viscosity between 40 and 150 $mm^2$/sec at 40° C. as described in claim 17 wherein (c) the polytetrafluoroethylene filler having a grain diameter of less than 5 $\mu$m is 1 to 60% by weight of said grease composition.

19. The grease composition with a kinetic viscosity between 40 and 150 $mm^2$/sec at 40° C. bearing for an electronically controlled throttle motor in an automobile filled with a grease composition with a kinetic viscosity between 40 and 150 $mm^2$/sec at 40° C. as described in claim 18 wherein (c) the polytetrafluoroethylene filler having a grain diameter of less than 5 $\mu$m is 5 to 30% by weight of the grease composition.

20. The grease composition for an electronically controlled throttle motor in an automobile filled with a grease composition with a kinetic viscosity between 40 and 150 $mm^2$/sec at 40° C. according to claim 14 or 15, further comprising a straight-chain perfluoropolyether oil with a kinetic viscosity between 40 and 150 $mm^2$/sec at 40° C. expressed by the formula $RfO(CF_2O)_p(C_2F_4O)_q(C_3F_6O)_r$ Rf wherein Rf is a perfluoro lower alkyl group, and p, q and r are integers whose total is between 50 and 80 composes less than 20 mass % of the base oil.

21. The grease composition with a kinetic viscosity between 40 and 150 $mm^2$/sec at 40° C. bearing for an electronically controlled throttle motor in an automobile filled with a grease composition with a kinetic viscosity between 40 and 150 $mm^2$/sec at 40° C. as described in claim 14 or 15, further comprising an antirust agent, a corrosion inhibiting agent or both.

22. The grease composition with a kinetic viscosity between 40 and 150 $mm^2$/sec at 40° C. for an electronically controlled throttle motor in an automobile according to claim 21, wherein said antirust agent is fatty acids, fatty acid soaps, fatty acid amines, alkyl sulfonic acid salts, oxidized paraffin, polyoxyalkylethers, sodium sulfonate, barium sulfonate, potassium sulfonate, calcium sulfonate, alkyl naphthalene, sodium nitrite or sodium nitrate.

23. The grease composition with a kinetic viscosity between 40 and 150 $mm^2$/sec at 40° C. for an electronically controlled throttle motor in an automobile filled with a grease composition with a kinetic viscosity between 40 and 150 $mm^2$/sec at 40° C. according to claim 21 wherein said corrosion inhibiting agent is benzotriazole, benzoimidazole or thiadiazole.

24. The grease composition with a kinetic viscosity between 40 and 150 $mm^2$/sec at 40° C. as described in claim 14 or 15 wherein said grease exhibits low torque at temperatures of from −40° C. to 180° C.

25. The grease composition with a kinetic viscosity between 40 and 150 $mm^2$/sec at 40° C. as described in claim 24 wherein said grease exhibits little evaporation or leakage at temperatures of from −40° C. to 180° C.

26. The grease composition with a kinetic viscosity between 40 and 150 $mm^2$/sec at 40° C. as described in claim 25 wherein said grease exhibits little evaporation or leakage at −40° C.

* * * * *